United States Patent [19]

Ackermann et al.

[11] Patent Number: 4,750,501

[45] Date of Patent: Jun. 14, 1988

[54] COSMETIC APPLICATOR WITH EVEN TORQUE AND IMPROVED LOCKING

[75] Inventors: Walter T. Ackermann, Watertown; Robert L. Pierpont, Meriden, both of Conn.

[73] Assignee: Risdon Corporation, Naugatuck, Conn.

[21] Appl. No.: 931,798

[22] Filed: Nov. 18, 1986

[51] Int. Cl.[4] ..... A45D 40/00

[52] U.S. Cl. ..... 132/79 C

[58] Field of Search ..... 401/78, 77, 86, 87, 401/79 C

[56] References Cited

U.S. PATENT DOCUMENTS

| | | | |
|---|---|---|---|
| 2,072,662 | 3/1932 | Abbotts . | |
| 2,840,230 | 6/1958 | Lerner | 401/78 |
| 2,874,384 | 2/1959 | Dulberg | 401/78 |
| 2,921,675 | 1/1960 | Clark . | |
| 3,083,822 | 4/1963 | Clark . | |
| 3,547,551 | 12/1968 | Gruska . | |
| 4,108,558 | 8/1978 | Radice . | |
| 4,166,707 | 12/1979 | Zawacki . | |
| 4,208,144 | 6/1980 | Idec | 401/78 |

*Primary Examiner*—Gregory E. McNeill

*Attorney, Agent, or Firm*—St. Onge Steward Johnston & Reens

[57] ABSTRACT

An improved cosmetic applicator is described in which an inner tubular member has cam slots to guide lugs on a carrier. The carrier supports a cosmetic substance such as lipstick and is moved between retracted and exposed positions by the action of helical grooves in an outer tubular member. A cam slot in the inner tubular member is provided with elongate resilient and flexible elements located to restrict the passage of the carrier lugs into and out of off-sets that provide axial carrier locking positions. The lugs can be moved past the elements which flex in a manner that retains an even swivel torque. A rib is mounted on the inner tubular member so as to contact the carrier and impart an even drag thereto.

16 Claims, 1 Drawing Sheet

COSMETIC APPLICATOR WITH EVEN TORQUE AND IMPROVED LOCKING

FIELD OF THE INVENTION

This invention relates to a container for a cosmetic or like substances. More specifically, this invention relates to a lipstick holder.

BACKGROUND OF THE INVENTION

A cosmetic applicator is described in U.S. Pat. No. 4,208,144 (now U.S. Pat. No. Re. 31,021). In such applicator a substance such as lipstick is placed on a carrier which in turn fits into an inner tubular member. An outer tube surrounds the inner tube which extends past the outer tube. The carrier is provided with a pair of lugs that serve as cam-followers and are in cam-tracking engagement with vertical cam slots in the inner tube and helical grooves on the inner wall of the outer tube. The vertical cam slot terminates at its ends in lateral off-sets that serve as axial locks to keep the carrier substance either in an exposed or retracted position.

The carrier and thus the lipstick is moved by causing relative swivel motion between the outer and inner tubes. The off-sets have slightly narrowed entrances so that the locking of the carrier requires some additional swivel torque. The size of such entrance relative to the cross-section of the carrier lugs tends to vary due to production tolerance requirements so that the locking and unlocking swivel torques do not remain sufficiently and reliably the same with different applicators.

The propulsion of the carrier occurs because of the forces from the helical grooves applied to the carrier lugs. The swivel torque required to move the carrier may, because of production tolerances, not have a sufficiently constant feel, being too high for some applicators or too low for others leading to a looseness feel that does not impart a desired sense of quality.

In U.S. Pat. No. 3,547,551 an axially-oriented rib is placed between inner and outer sleeves of a lipstick-holder to impart a frictional brake to oppose relative rotary motions between the sleeves.

SUMMARY OF THE INVENTION

With a cosmetic applicator in accordance with the invention the propell and retract actions of the substance carrier are made very smooth and with reliable locking. This is achieved with one applicator in accordance with the invention by applying an axially-oriented rib on the inner tube wall facing the carrier. The rib is sized to contact the carrier and thus apply a constant drag throughout its travel path. The rib improves the consistency of the swivel torque of different applicators. The locking of the carrier is obtained with a resilient flexible bar element that is so placed across the cam slot off-sets on the inner tube so as to require flexure of the bar element to move a carrier lug into a locking position.

The resulting propelling and retraction movements of the carrier require a swivel torque that tends to remain the same from one applicator to another without wobbling of the carrier and introduce an enhanced feel of quality.

It is, therefore, an object of the invention to provide an applicator of cosmetic and similar substances with an enhanced propelling and retraction action and more reliable locking.

These and other advantages and objects of the invention can be understood from the following detailed description of an embodiment that is described with reference to the drawings.

DETAILED DESCRIPTION OF DRAWINGS

Figure 1:
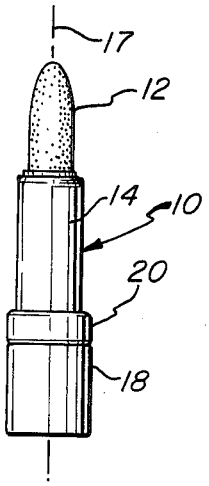
FIG. 1 is a side view in elevation of an applicator in accordance with the invention.
Figure 2:
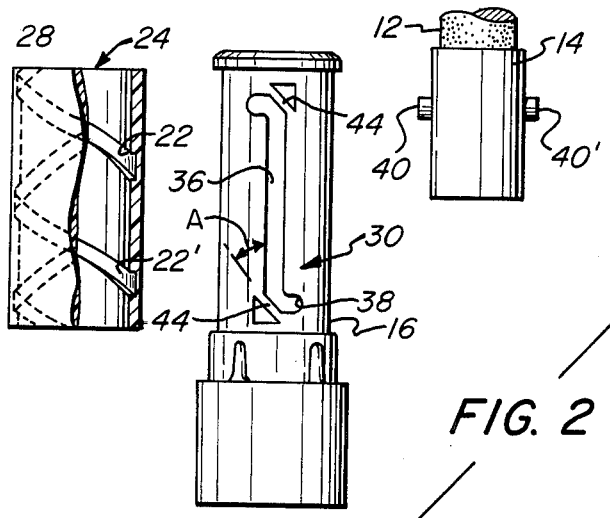
FIG. 2 is a collection of four views in elevation of the parts used in the applicator of FIG. 1.

With reference to FIGS. 1 and 2 an improved cosmetic applicator 10 in accordance with the invention is shown with an exposed lipstick 12 on a carrier 14. A cover for the applicator is not shown. The carrier 14 moves between an exposed fully propelled position as illustrated and a retracted position inside an inner tube 16 that is rotatable about an axis 17 relative to an outer tube 18. The inner tube is interlocked with a band 20 so that rotation or swivel action of the outer tube 18 relative to the inner tube 16 can be done by gripping band 20 and an outer cover 19 to raise or lower the carrier 14 and lipstick 12. The carrier 14, inner and outer tubes 16 and 18 are preferably made of plastic molded parts.

The outer tube 18 is provided as in U.S. Pat. No. 4,208,144 with a pair of helical cam-grooves 22, 22' that extend from a lower end to an upper opening 24. The inner tube 16 as described in this patent fits inside outer tube 18 and is provided with a bead 26 around its upper opening to snap fit into a complementary-sized circumferential groove 28 at the opening 24. In this manner inner tube 16 is axially retained inside outer tube 18 but the latter can rotate relative to the inner tube 16.

Figure 3:
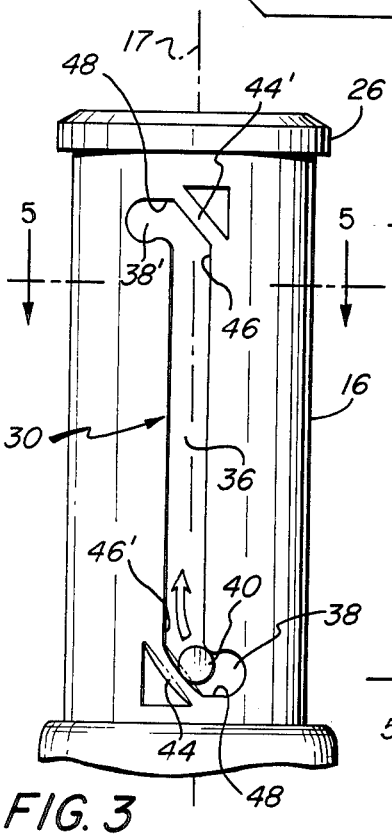
FIGS. 3 and 4 are enlarged respectively front and rear views in elevation of the inner tube used in the applicator of FIG. 1.
Figure 4:
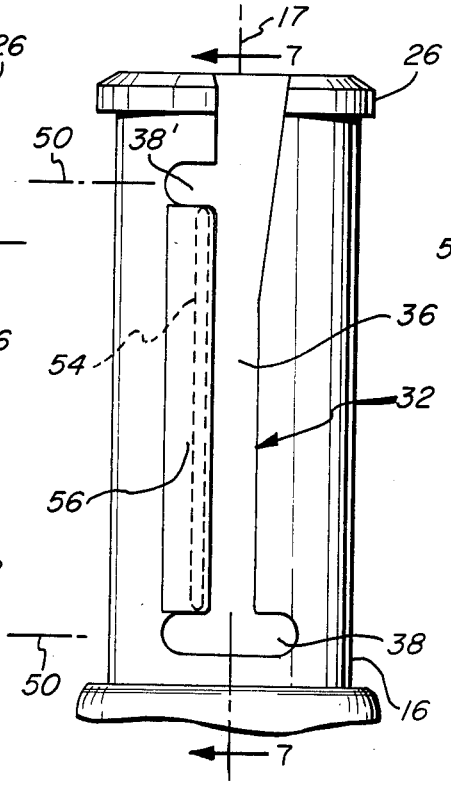
Figure 7:
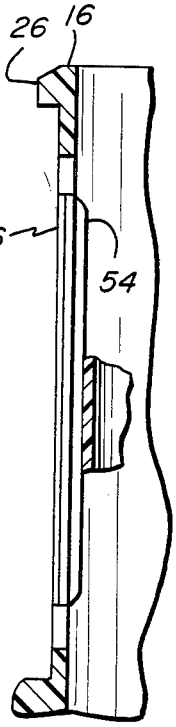
FIG. 7 is a section view in elevation of the inner tube taken along the line 7—7 in FIG. 4.
Figure 5:
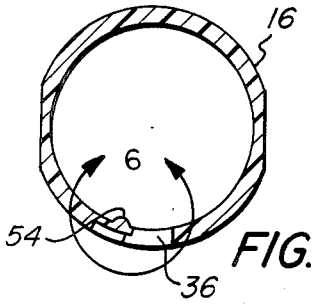
FIG. 5 is a sectional view of the applicator taken along line 5—5 in FIG. 4.
Figure 6:
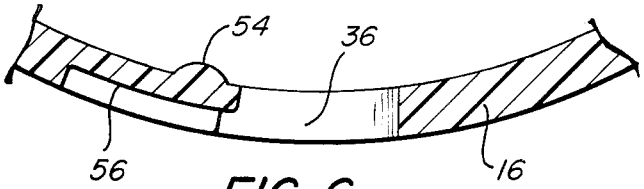
FIG. 6 is enlarged view of the encircled portion 3 in FIG. 5.

The inner tube 16 further is provided with a pair of cam slots 30, 32 on diametrically opposite sides. The rear slot 30 is visible in the views of FIGS. 2 and 3 while the front slot 32 is shown in FIGS. 4–6.

Each cam slot 32, 34 has an axially aligned straight segment 36 and lateral dogleg off-sets 38, 38' at respectively lower and upper axial ends of the cam slots 30, 32. The off-sets 38, 38' serve as locking places where the carrier 14 is held in a retracted or extended position.

The carrier 14 is provided at its lower end with diametrically opposite lugs 40, 40' which respectively operatively engage cam slots 30, 32 and helical cam grooves 22, 22'. Hence, as outer tube 18 is rotated, the cam grooves 22, 22' act on the lugs 40, 40' to propel the carrier 14 either to an exposed position as shown in FIG. 1 or a retracted position. The carrier 14 thus moves axially until the end of the straight cam slots 36 are encountered where cam grooves 22, 22' drive the lugs 40, 40' into the off-sets 38, 38'.

One aspect of the invention is the use of elongate locking elements 44, 44' at the ends of the straight cam slot segment 36 in the inner tube 16 at its front cam slot 30. The locking elements are each formed of a resilient flexible narrow bar that is made of the same parent material of which the inner tube 16 is made. The flexible locking bar elements 44, 44' are so located relative to the straight cam slot segment 36 and off-sets 38, 38' as to restrict the free passage of carrier lugs 40, 40'.

Hence, movement of a lug 40 into an off-set requires at least some flexure of a locking element, but in a manner whereby the carrier appears to smoothly detent into a locked end position. When a lug is urged away from a locked position in an off-set, the flexure of the locking element 44 responds in a similarly smooth detent manner. The effect of a locking element thus initially presents a slight resistance which, after it is overcome, is followed by accelerated lug movement due to the resilience of the locking element.

The amount of resilience and flexure of the locking bar elements 44, 44' can be controlled by selecting their widths and locations relative to the cam slot segment 36 and off-sets 38, 38'. The placements of the locking elements 44, 44' are preferably so selected that the resilient bars extend from an edge 46 of cam slot segment 36 that is opposite to an off-set 38 to an outside edge 48 of an off-set 38. This orients the locking bar elements 44 at an angle A relative to the center line of the straight cam slot segment 36 as well as center line 50 of the off-sets 38. The angle A may be of the order of about 40°. The width of the narrow bar elements can be about 0.040 inches. The thickness of the wall of inner tube 16 is of the order of 0.020 inches.

In another aspect of the invention as illustrated with reference to FIGS. 4–7, the inner tube 16 is formed with an inwardly facing rib 54. The rib 54 is oriented axially to extend parallel to the axis 17 between off-sets 38, 38'. Rib 54 is further sized to sufficiently extend inwardly so as to contact the carrier 14 and apply a constant frictional drag to it as it is moved between retracted and extended positions.

Rib 54 is preferably placed on a somewhat radially flexible cantilevered flange segment 56 that is located adjacent the front cam slot 32. Flange 56 is circumferentially curved and formed by the inner tube segment that extends axially from off-set 38' to a recess 58 that is located opposite off-set 38. Recess 58 does not operate as part of the cam slot 32. Flange 56 is of reduced thickness as can be seen in the view of FIG. 6 to enhance the flange's flexibility. The flange thickness may be about 0.010 inches.

With a radially flexible flange 56, an excessive drag force on carrier 14 is avoided since an oversized carrier 14 or an undersized inner tube would merely cause a small outward flexure of the flange 56.

With an applicator 10 as thus described, movement of the carrier 14 can be done in and out of the locked end positions with a relatively constant swivel torque. The highly resilient bar elements 44 maintain this in spite of variations in the diameter of the carrier lugs 40 or the sizes of the openings leading to the locked positions as determined by the dogleg off-sets 38.

The travel motion of the carrier 14 is smoothed by the even drag placed on it by rib 54 which advantageously also eliminates or reduces carrier wobble.

Having thus described an applicator in accordance with the invention its advantages can be appreciated. Variations can be made without departing from the scope of the invention as determined by the following claims.

What is claimed is:

1. In an applicator in which a carrier is provided to support a cosmetic or a similar substance and has a lug that is in cam-follower tracking engagement with axial propulsion cams of inner and outer rotatable coaxially-mounted tubular members, said tubular members each having an open end through which the carrier supported substance is to be exposed, the outer tubular member having a wall with at least one helical cam groove extending from a lower end to near the open end and with the inner tubular member having a straight axially-oriented cam slot with laterally extending off-sets at respective retraction-limiting and propulsion-limiting ends of the slot and with the lug operatively engaging the slot and the helical groove, the improvement comprising:

an elongate resilient flexible element on the inner tubular member oriented at an angle relative to the straight axial cam slot and located opposite an off-set so as to sufficiently choke off the passage from the cam slot to the off-set that the lug's movement into and outwardly from the off-set requires a flexure of the element.

2. The applicator as claimed in claim 1 wherein the flexible element extends from one side of the cam slot that is opposite to the off-set to an outer edge of the off-set.

3. The applicator as claimed in claim 2 wherein the flexible element orientation angle relative to the axis of propulsion is of the order of about 40°.

4. The applicator as claimed in claim 3 wherein the width of the flexible element is of the order of about 0.040 inches and its thickness about 0.020 inches.

5. The improved applicator as in claim 1 wherein at least a pair of said flexible elements is on said inner tubular member with each said element being similarly placed relative to an off-set.

6. The improved applicator as in claim 5 wherein said flexible elements are in the shape of elongate flexible and resilient bars.

7. In an applicator in which a carrier is provided to support a cosmetic or a like substance and has a lug that is in cam-follower tracking engagement with axial propulsion cams of inner and outer rotatable coaxially mounted tubular members, said tubular members each having an open end through which the carrier supported substance is to be exposed, the outer tubular member having at least one helical cam groove extending from a lower end to near the open end and with the inner tubular member having a straight axially oriented cam slot with laterally extending off-sets at respective retraction-limiting and propulsion-limiting ends of the slot and with the lug operatively engaging the slot and the helical groove, the improvement comprising:

a said inner tube having an inwardly extending axially aligned rib on the inner tubular member, said rib being sized to contact the carrier and provide an effectively even drag to the carrier as it is moved between ends of the slot in the inner tube.

8. The improved applicator as claimed in claim 7 wherein the rib is located adjacent an edge of the straight axially oriented cam slot.

9. The improved applicator as claimed in claim 8 wherein the rib extends to the off-sets.

10. The improved applicator as claimed in claim 7 wherein the inner tubular member is provided with an axially elongate radially flexible cantilevered flange, and where said rib is on said flange.

11. The improved applicator as claimed in claim 10 wherein said flange has a cantilevered end placed as an edge along side a cam slot in the inner tubular member.

12. In an applicator in which a carrier is provided to support a cosmetic or a similar substance and has a lug that is in cam-follower tracking engagement with axial propulsion cams of inner and outer rotatable coaxially-mounted tubular members, said tubular members each having an open end through which the carrier supported substance is to be exposed, the outer tubular member having a wall with at least one helical cam groove extending from a lower end to near the open end and with the inner tubular member having a straight axially oriented cam slot with laterally extending off-sets at respective retraction-limiting and propulsion-limiting ends of the cam slot, and with the lug adapted to operatively engage the cam slot and the helical groove, the improvement comprising:

a resilient flexible elongate element on the inner tubular member and oriented at an angle relative to the straight axial cam slot and located opposite an off-set so as to sufficiently choke off the passage from the cam slot to the off-set that the lug's movement into and outwardly from the off-set requires a flexure of the element, and an axially aligned rib on the inner tubular member, said rib being sized to contact the carrier and provide an effectively even drag to the carrier as it is moved between ends of the cam slot in the inner tubular member.

13. The improved applicator as claimed in claim 12 wherein the inner tubular member has a front cam slot and a rear cam slot and wherein said outer tubular member has at least a pair of diametrically opposite helical grooves and the carrier has at least a pair of said lugs each of which lugs being adapted to operatively engage a cam slot and a helical groove, the improvement comprising:

an inner tubular member wherein each said cam slot has laterally extending off-sets at the ends of the cam slots to receive a carrier lug, with a first of said cam slots having resilient flexible elements operatively disposed across the latter cam slot and respectively opposite each off-set located at the ends of the latter cam slot.

14. The improved applicator as claimed in claim 13 wherein said inner tubular member has a radially flexible, axially oriented circumferentially cantilevered flange, with said rib mounted on the flange.

15. The improved applicator as claimed in claim 14, wherein said resilient flexible element is in the shape of an elongate narrow bar.

16. The improved applicator as claimed in claim 15, wherein said second cam slot has a lateral side formed by said flange.

* * * * *